US006647671B1

(12) United States Patent
Alley

(10) Patent No.: US 6,647,671 B1
(45) Date of Patent: Nov. 18, 2003

(54) SNOW GUARD MOUNTING ASSEMBLY WITH A LEVERED LOCKING MECHANISM

(76) Inventor: F. William Alley, Gebbie Rd., Greensboro, VT (US) 05841

( * ) Notice: Subject to any disclaimer, the term of this patent is extended or adjusted under 35 U.S.C. 154(b) by 35 days.

(21) Appl. No.: 09/952,179

(22) Filed: Sep. 11, 2001

(51) Int. Cl.[7] ..... E04D 13/00
(52) U.S. Cl. ..... 52/25; 52/24; 52/25
(58) Field of Search ..... 52/24, 25

(56) References Cited

U.S. PATENT DOCUMENTS

| | | | | |
|---|---|---|---|---|
| 42,992 | A | 5/1864 | Howe | |
| 5,613,328 | A | 3/1997 | Alley | |
| 5,732,513 | A | 3/1998 | Alley | |
| 6,256,934 | B1 * | 7/2001 | Alley | 52/25 |

OTHER PUBLICATIONS

U.S. patent application Ser. No. 09/397,938, Alley, filed Sep. 17, 1999.

U.S. patent application Ser. No. 09/933,221, Alley, filed Aug. 20, 2001.

* cited by examiner

*Primary Examiner*—Carl D. Friedman
*Assistant Examiner*—Steve Varner
(74) *Attorney, Agent, or Firm*—Burr & Brown

(57) ABSTRACT

A snow guard assembly adapted to be attached to a metal roof seam is provided, having a mounting assembly for having increased gripping efficiency. The mounting assembly includes a mounting block having a seam-receiving groove, and at least one channel formed on an internal side of the seam-receiving groove. A lever member disposed within each channel is pivotally secured at one end by a pivot member. A coupling element passes through a side of the mounting block proximate the other end of the lever member. When the coupling element contacts the lever member, the lever member moves from the channel to a position within the seam-receiving groove. The metal roof seam housed in the seam-receiving groove is deformed under force provided by the mechanical advantage of the lever to form a gripping area that secures the mounting assembly to the metal roof seam and prevents relative movement therebetween.

27 Claims, 7 Drawing Sheets

2nd DIRECTION
LONGITUDINAL DIRECTION
400
420
500
520
530
600
700
701
702
704
707
710
711
712
714
717
720
721
722
724
727
730
731
732
734
737
800
810
820
830
410
430
510
200
201
202
300

SNOW GUARD MOUNTING ASSEMBLY WITH A LEVERED LOCKING MECHANISM

BACKGROUND OF THE INVENTION

The present invention relates generally to a roof-mounted snow guard assembly to retain accumulated snow and prevent damage and injury caused by snow sliding off the roof surface, and more particularly, to an improved mounting block for securing such snow guard assemblies to a metal roof seam.

Snow guard assemblies have long been used for inhibiting and directing the movement of snow and ice across selected or pitched areas of roofs, as a preventive measure to mitigate the damage caused by migrating and falling snow and ice accumulations. An early application of snow guard assemblies is taught in U.S. Pat. No. 42,992 to Howe, which issued May 31, 1864. Recently, snow guard assemblies have increased in popularity, and currently several snow guard mounting assemblies serve to hold snowloads on roofs. Relevant examples include U.S. Pat. Nos. 5,613,328, and 5,732,513, each to Alley, each of which is herein incorporated in its entirety by reference.

Changing weather conditions, such as high winds or cyclically varying temperatures, create an environment that can induce physical changes in the accumulated snow, and give rise to the conditions tending to cause a snowpack to slide off of a sloped roof. Dislocated snow and ice often cause damage to surrounding property and, in some cases, the sliding snow can cause serious bodily injury; The problem of sliding snow is particularly prevalent on metal roofs. Metal roofs offer many structural advantages, such as strength and durability. However, because metal tends to absorb environmental heat, even a minimal amount of panel expansion or contraction exacerbates the conditions leading to snow slides. Furthermore, metal roofs generally afford little surface friction, which is also conducive to snow slides.

The increasing popularity of construction incorporating metal roof materials also poses particular problems with respect to attaching snow guard assemblies. A typical metal roof comprises a plurality of juxtaposed metal panels typically having substantially perpendicular edges that abut to form a joint therebetween. The perpendicular edges of the abutting panels are each crimped together and/or bent downwardly over each other forming a sealed seam which both connects the roofing panels and prevents fluid communication in between the panels and to the area beneath the roof panels,.

In snow guard assemblies for seamed metal roofs, the mounting block assembly is typically secured to the roof seam using a coupling element, such as screws or bolts. These screws or bolts generally pass through a sidewall of the mounting block seated around the seam, and extend inwardly, to contact the roof seam. However, screws and bolts tend to puncture, abrade, or otherwise damage the surface coating of the metal roof seam seal when tightened to securely fasten the mounting assembly. Holes or fissures thusly created during installation and use, and which remain after removal of the mounting assembly, destroy the hermeticity of the metal roof, and allow water to permeate the seam even while the snow guard is still attached. The water tends to attack the exposed metal beneath the damaged surface coating, creating stains, such as rust stains. This water damage weakens the metal and diminishes the intrinsic aesthetic qualities of metal roofs.

Prior attempts to address this problem include using a mounting block capable of being attached to a metal roof, as described U.S. Pat. No. 5,613,328. In order to attach the mounting block to the seam, a ball and set-screw is provided, such that the curved surface of the ball, rather than the threads of the screw, engages a portion of the roof seam. As the screw is tightened to attach the mounting block, the ball forms a pocket in the engaged portion of the seam such that the mounting block can be secured to the roof without piercing or tearing the seam.

Although this method of attachment is an improvement over the prior art attaching means, drawbacks remain. For example, the entire holding force per coupling means is limited to the contact area between the seam and each ball, which is only a singular, independent contact surface. Because such a design requires that the entire contact force be applied through a single contact surface on each ball, the total amount of static holding force (which is equal to the summation of the holding forces of each individual contact surface) is determined by the number of balls engaging the roof seam. Thus, the net holding force available for holding the mounting block in place is significantly limited, and sliding will occur if the force of the snow load exceeds the friction force at that singular point of contact.

Yet another drawback of the ball and set-screw assembly relates to the occasional rotation of the ball in conjunction with the turning of the set screw instead of gripping to form a stationary contact surface with the metal seam. This unwanted turning gives rise to damage on the contact surface of the seam, and effectively reduces the benefits of employing a ball and set-screw coupling means.

Another attempt to attach the mounting block to a metal roof seam involves the cam-like gripping means disclosed in U.S. Pat. No. 5,613,328 to Alley, the entirety of which is incorporated by reference herein. The cam is a small gripping member, whose length is not significantly greater than its width, which is positioned in a chamber on an internal side of the groove of the securing block and secured at one end. In one case, the securing block is slid along the roof seam in a direction that causes the unsecured end of the cam to catch the seam, swing out from the chamber and deform the metal roof seam, at which point the cam is locked in place using a screw. In this manner, the dented seam is gripped between the cam and a cavity located on the opposite side of the groove of the securing block therefrom. In another case, a set-screw and ball bearing configuration engages the unsecured end of the cam within the chamber, forcing the cam out of the chamber and into the groove, such that the dented seam is gripped between the cam and an opposing cavity on the other side of the groove.

While the cam, rather than a set-screw or ball bearing, contacts the metal roof seam and offers some protection for the metal roof seam, there is still room for improvement with respect to increased protection and gripping power. First, the effective gripping force is somewhat limited by the cam configuration. That is, damage can occur at the point of contact between the roof seam and the cam if too much force is used on the cam, or under the stress of a heavy snow load, because the pressure applied by the cam on the metal roof seam is essentially concentrated at that point of contact. Second, no substantial mechanical advantage with respect to gripping power is offered over the standard ball and set-screw assembly because the length of the cam is not significantly greater than its width.

Another drawback associated with prior art mounting block assemblies for snow guard assemblies relates to corrosion caused by the contact between the metal roof seam and the metal groove of the mounting block, in conjunction with the normal exposure to high degrees of moisture experienced by roofs. The corrosion is a result of a galvanic reaction between the metal roof, which is typically copper, and the metal of the mounting block, which is typically aluminum. This can lead to many harmful conditions, both cosmetic and structural, including unsightly deposits on the roof panels and a weakened coupling between the seam and snow guard assembly. Additionally, corrosion and moisture infiltration eventually degrade the hermeticity of the metal roof.

Efforts to combat corrosion caused by galvanic reactions include fabricating the mounting block using a non-reactive metal, such as stainless steel. However, using stainless steel instead of aluminum significantly increases overall manufacturing and consumer costs, and does not address the problem of moisture communication and physical harm to the surface of the seam caused by fastening with screws or bolts. Another attempt to combat reactivity involves using a non-corrosive insert as an interface in the metal groove of the mounting block, between the mounting block and the roof seam, as described in Applicant's pending application Ser. No. 09/397,938, the entirety of which is incorporated herein by reference. However, such non-reactive inserts do not afford the seam protection from invasive coupling means, since the coupling means penetrate the inserts and directly contact the seam.

Thus, it would be desirable to provide a cost effective snow guard assembly having a means for securing a mounting block assembly onto a metal roof seam which prevents physical breach of the seam integrity by a coupling means, and which reduces detrimental galvanic reactions between the securing means and the metal roof seam, to better preserve the structural fortitude and hermeticity of the metal roof. Further, it would be desirable to provide a snow guard assembly having a means for securing a mounting block assembly onto a metal roof seam with increased gripping efficiency, whereby the amount of force required to ensure a stable connection does not exceed that which harms the metal roof seam.

SUMMARY OF THE INVENTION

It is an object of the present invention to overcome the drawbacks of the prior art, particularly to provide a snow guard assembly having a mounting assembly having a means for attachment with increased gripping efficiency, but which does not compromise the surface integrity of the metal roof seam or otherwise threaten the hermeticity of the metal roof.

In accordance with one embodiment of the present invention, a snow guard system adapted to be attached to a metal roof seam by a mounting assembly is provided. The mounting assembly includes a mounting block having a seam-receiving groove formed in a bottom surface thereof, partially defined by a first internal side, an opposed second internal side, and an upper internal side interposed therebetween, wherein the upper internal side is spaced apart from the bottom surface of the mounting block in a first direction. The seam-receiving groove extends longitudinally from a front end of the mounting block to a back end thereof in a longitudinal direction of the mounting block substantially perpendicular to the first direction. A first channel is also included, formed in the first internal side of the seam-receiving groove and extending in the longitudinal direction from a first end thereof to an opposed second end thereof. The mounting assembly further includes a lever member disposed within the channel. The lever member includes a first end and an opposed second end defining a length, L, extending therebetween in the longitudinal direction, and a first side and an opposed second side defining a width, W, extending therebetween in a second direction substantially perpendicular to the first direction and the longitudinal direction. Further, L is greater than or equal to 3W, and second side is of the lever member adapted to contact a metal roof seam preferably includes at least one protruding portion.

The mounting assembly also includes a pivot member for pivotally securing one of the first and second ends of the lever member such that the other end thereof is freely translocatable from a position within the channel to a position within the seam-receiving groove along the second direction toward a central axis of the seam-receiving groove. A coupling element is also included, having a terminal end extending through a first side of the mounting block and adapted to move inwardly toward the central axis of the seam-receiving groove and penetrate the channel portion to engage a portion of the lever member proximate the other end thereof.

Preferably, the second internal side of the seam-receiving groove further includes one of a recess or a protrusion substantially axially aligned with the pivotally secured end of the lever member across the central axis of the seam-receiving groove. The preferred lever member further includes one of a recess or a protrusion on the second side thereof, substantially and preferably proximate the pivotally secured end thereof. Suitable materials for the lever member include, but are not limited to, stainless steel, aluminum alloys, anodized aluminum, copper and copper alloys. At least the second side of the lever member is coated with a corrosion-resistant, non-metallic coating. Suitable materials for the corrosion-resistant, non-metallic coating include, but are not limited to urethane, epoxy, plastic and aluminum oxide.

More preferably, the seam-receiving groove includes another channel portion formed in the first internal side thereof longitudinally spaced apart from the first channel in the second direction and extending in the longitudinal direction from a first end thereof to an opposed second end thereof, another lever member disposed within the other channel, another pivot member for pivotally securing one of the first and second ends of the other lever member such that other end thereof is freely translocatable from a position within the channel to a position within the seam-receiving groove along the second direction toward a central axis of the seam-receiving groove, and another coupling element having a terminal end extending through a first side of the mounting block.

In accordance with another embodiment of the present invention, a snow guard system is provided, incorporating a mounting assembly including a mounting block having a seam-receiving groove formed in a bottom surface thereof. The seam-receiving groove is partially defined by a first internal side, an opposed second internal side, and an upper internal side interposed therebetween, and the upper internal side is spaced apart from the bottom surface of the mounting block in a first direction. The seam-receiving groove extends longitudinally from a front end of the mounting block to a back end thereof in a longitudinal direction of the mounting block substantially perpendicular to the first direction. The mounting assembly further includes a first channel formed in the first internal side of the seam-receiving groove and extending in the longitudinal direction from a first end thereof to an opposed second end thereof, and a second channel formed in the second internal side of the seam-receiving groove and extending in the longitudinal direction from a first end thereof to an opposed second end thereof. A first lever member disposed within the first channel is also included, having a first end and an opposed second end defining a length, $L_1$, extending therebetween in the longitudinal direction, and a first side and an opposed second side defining a width, $W_1$, extending therebetween in a second direction substantially perpendicular to the first direction and the longitudinal direction, wherein the second side is adapted to contact a metal roof seam. Further, a second lever member disposed within the second channel, includes a first end and an opposed second end defining a length, $L_2$, extending therebetween in the longitudinal direction, and a first side and an opposed second side defining a width, $W_2$, extending therebetween in a second direction substantially perpendicular to the first direction and the longitudinal direction, wherein the second side is adapted to contact a metal roof seam.

The mounting assembly also includes a first pivot member for pivotally securing the one of the first and second ends of the first lever member such that the other end thereof is freely translocatable from a position within the first channel to a position within the seam-receiving groove along the second direction toward a central axis of the seam-receiving groove. Further, a second pivot member is provided for pivotally securing one of the first and second ends of the second lever member such that the other end thereof is freely translocatable from a position within the channel to a position within the seam-receiving groove along the second direction toward a central axis of the seam-receiving groove. A first coupling element is also included, having a terminal end extending through a first side of the mounting block and adapted to move inwardly toward the central axis of the seam-receiving groove and penetrate the first channel to engage a portion of the first lever member proximate the other end thereof. Further, a second coupling element is included, having a terminal end extending through a second side of the mounting block and adapted to move inwardly toward the central axis of the seam-receiving groove and penetrate the second channel to engage a portion of the second lever member proximate the other end thereof.

Preferably, the first lever member further includes at least one of a protrusion and a recess proximate the pivotally secured end thereof and substantially aligned with one of the ends of the opposed second lever member in the second direction across the central axis of the seam-receiving groove. Additionally, the second lever member preferably includes at least one of a protrusion and a recess on the second side thereof and proximate the pivotally secured end. Preferably, the protrusions and recesses of each lever member correspond such that the recesses align with the respective opposing protrusions. The respective opposing recesses are preferably axially offset from one another along the longitudinal direction, and the respective opposing protrusions are likewise preferably axially offset. It is also preferred that the first channel is substantially aligned with the second channel such that the first and second channels oppose one another in the second direction across the central axis of the seam-receiving groove. Alternately, the first channel is offset from the second channel in the longitudinal direction such that the first and second channels do not substantially axially oppose one another in the second direction across the central axis of the seam-receiving groove.

Preferably, the mounting assembly also includes a third channel formed in one of the first and second internal sides of the seam-receiving groove extending in the longitudinal direction from a first end thereof to an opposed second end thereof. A third lever member is preferably disposed therewithin, and a third pivot member is provided for pivotally securing one of the first and second ends of the third lever member such that the other end thereof is freely translocatable from a position within the third channel to a position within the seam-receiving groove along the second direction toward a central axis of the seam-receiving groove. Further, a third coupling element is included, having a terminal end extending through a corresponding side of the mounting block and adapted to move inwardly toward the central axis of the seam-receiving groove and penetrate the third channel to engage a portion of the third lever member proximate the other end thereof.

More preferably, the mounting assembly further includes a fourth channel formed in the other internal side of the seam-receiving groove, and a fourth lever member disposed therewithin. A fourth pivot member is also provided, positioned proximate one of the first or the second ends of the fourth lever member, as well as a fourth coupling element extending through a corresponding side of the mounting block. The fourth coupling element is adapted to move inwardly toward the central axis of the seam-receiving groove and penetrate the fourth channel to engage a portion of the fourth lever member proximate the other end thereof.

BRIEF DESCRIPTION OF THE DRAWINGS

For a fuller understanding of the nature and objects of the invention, reference should be made to the following detailed description of a preferred mode of practicing the invention, read in connection with the accompanying drawings, in which.

DETAILED DESCRIPTION OF THE DRAWINGS

Figure 1:
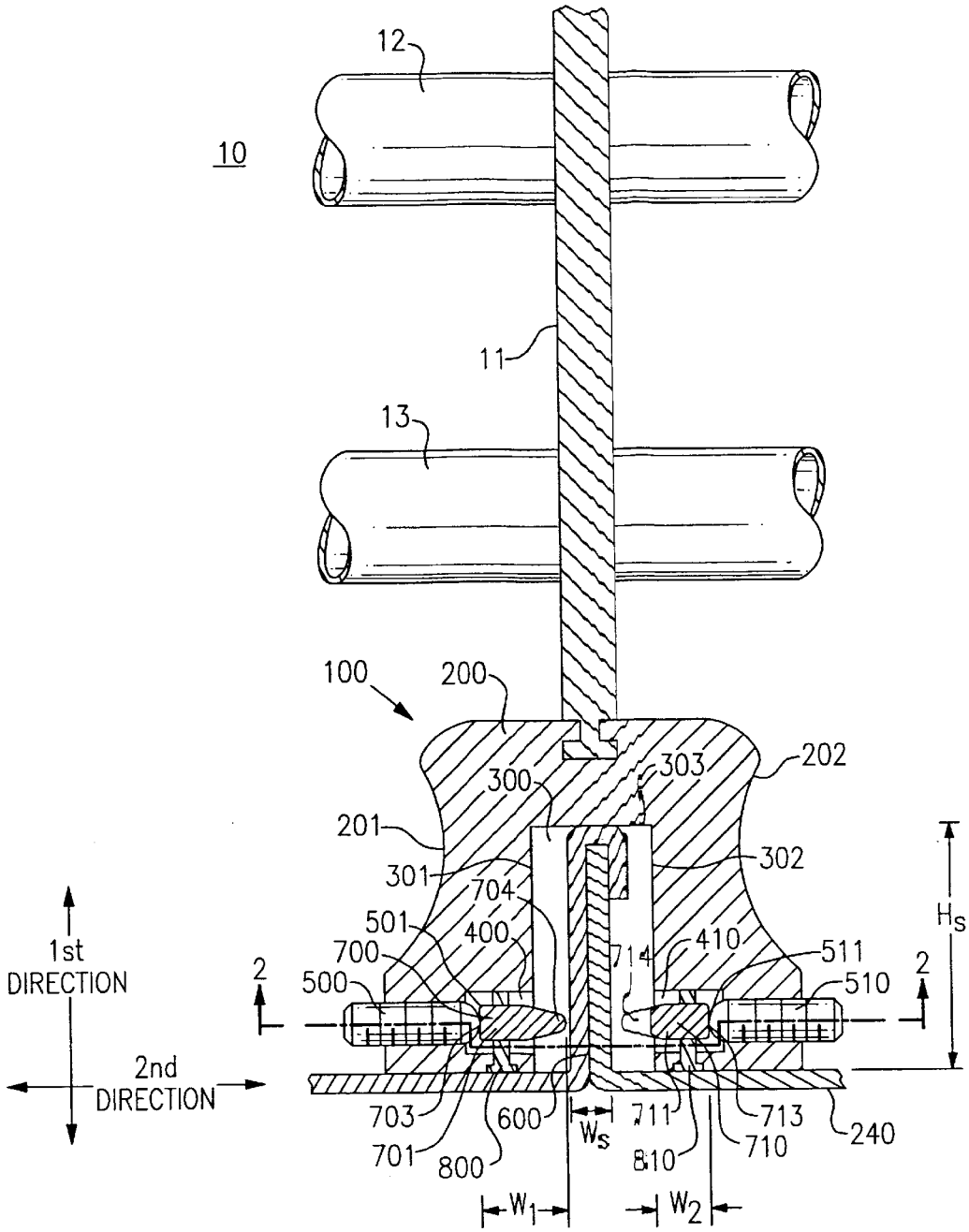
FIG. 1 is a cross-sectional front view of a snow guard assembly according to one embodiment of the present invention, shown positioned about a metal roof seam.

While the present invention has been particularly shown and described with reference to the preferred mode as illustrated in the drawings, it will be understood by one skilled in the art that various changes may be effected therein without departing from the spirit and the scope of the invention as defined by the claims.

FIG. 1 a cross-sectional front view of a snow guard assembly 10 according to one embodiment of the present invention, including bracket 11, snow guard pipes 12 and 13, and mounting assembly 100. The mounting assembly 100 is positioned about a metal roof seam 600 having a height, Hs, extending in the first direction, a width, Ws, extending in the second direction, and a length, Ls, extending in the longitudinal direction of the mounting block 200 substantially perpendicular to the first direction. The mounting assembly 100 includes mounting block 200 having seam-receiving groove 300 formed on the bottom surface 205 thereof. The seam-receiving groove 300 is partially defined by a first internal side 301, an opposed second internal side 302, and an upper internal side 303 interposed therebetween and spaced apart from the bottom surface 205 of the mounting block 200 in a first direction. Seam-receiving groove 300 extends longitudinally from a front end 240 of mounting block 200 to a back end 250 thereof in the longitudinal direction of the mounting block 200.

A first channel 400 is formed in the first internal side 301 of seam-receiving groove 300, extending in the longitudinal direction from a first end 401 (not shown) thereof to an opposed second end 402 (not shown) thereof, and a second channel 410 is formed in the second internal 302 side of seam-receiving groove 300, likewise extending in the longitudinal direction from a first end 411 (not shown) thereof to an opposed second end 412 (not shown) thereof. A second channel 410 formed in the second internal side 302 of seam-receiving groove 300 substantially opposes the first channel 400 over a distance in the second direction and across the central axis of the seam-receiving groove.

The seam-receiving groove 300 and the channels 400 and 410 can be formed by a variety of manufacturing methods. For example, the seam-receiving grove and the channels can be incorporated into the mold structure, such that the post-casting mounting block 200 includes either or both. Another method for forming the seam-receiving groove and the channels involves post-cast machining to form the structures in the substantially solid-cast mounting block. The seam-receiving groove 300 preferably extends longitudinally along the entire length of the mounting block to provide the desired fit with the metal roof seam. The channels 400 and 410 extend over a variety of lengths limited only by the length of the seam-receiving groove 300. Preferably, the channels are a sufficient length to house a lever member having a predetermined length as described below.

A first lever member 700 is disposed within the first channel 400, having a first end 701 and an opposed second end 702 (not shown) defining a length, $L_1$, extending therebetween in the longitudinal direction. The first lever member 700 also includes a first side 703 and an opposed second side 704 defining a width, $W_1$, extending therebetween in a second direction substantially perpendicular to the first direction and the longitudinal direction, and the second side 704 is adapted to contact a metal roof seam. A second lever member 710, likewise disposed within the second channel 410, includes a first end 711 and an opposed second end 712 (not shown) defining a length, $L_2$, extending therebetween in the longitudinal direction. The second lever member 710 further includes a first side 713 and an opposed second side 714 defining a width, $W_2$, extending therebetween in a second direction substantially perpendicular to the first direction and the longitudinal direction, and the second side 714 is adapted to contact a metal roof seam.

A first pivot member 800 is provided, and adapted to pass through the bottom surface 205 of mounting block 200 in the first direction proximate the first side 201 thereof and penetrate the first channel 400. The first pivot member 800 contacts and pivotally secures the first lever member 700 proximate the first end 701 thereof, and proximate the first end 401 of the first channel 400. In that manner, the second end 702 and a portion of the length, $L_1$, of lever member 700 are freely translocatable from a position within the first channel 400 to a position within the seam-receiving groove 300 along the second direction toward the central axis thereof. A second pivot member 810 is also provided, and adapted to pass through the bottom surface 205 of mounting block 200 in the first direction proximate the second side 202 thereof, penetrate the second channel 410. The second pivot member 810 contacts and pivotally secures the second lever member 710 proximate the second end 712 thereof, and proximate the second end 412 of the second channel 410. In that manner, the first end 711 and a portion of the length, $L_2$, of the second lever member 710 are freely translocatable from a position within the second channel 410 to a position within seam-receiving groove 300 along the second direction toward the central axis, thereof.

FIG. 1 further shows a first coupling element 500 having a terminal end 501 extending in the second direction through a first side 201 of the mounting block 200 and adapted to move inwardly toward the central axis of seam-receiving groove 300 to penetrate a portion of the first channel 400 channel and engage a portion of the first lever member 700 proximate the second end 702 thereof. A second coupling element 510 is also included, having a terminal end 511 extending in the second direction through the second side 202 of the mounting block 200 and adapted to move inwardly toward the central axis of seam-receiving groove 300 and penetrate a portion of the second channel 410 to engage a portion of the second lever member 710 proximate the first end 711 thereof. The second coupling element 510 is further positioned such that the terminal end 511 thereof axially opposes the terminal end 501 of the first coupling element 500 across the central axis of the seam-receiving groove.

Figure 2A:
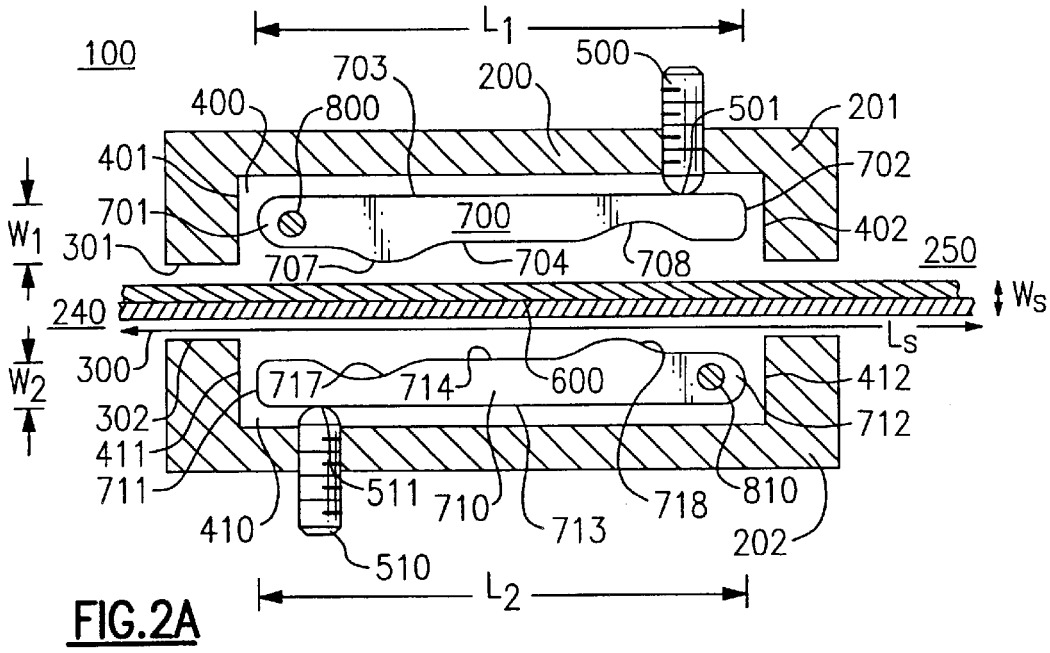
FIG. 2A is a cross-sectional view of the mounting assembly and metal roof seam taken through line 2—2 in FIG. 1.

FIG. 2A is a cross-sectional view of the mounting assembly 100 taken in the second direction through line 2—2 of FIG. 1, wherein the seam-receiving groove 300 of mounting block 200 is positioned over a metal roof seam 600. The longitudinal direction of the mounting block 200 corresponds to a portion of the length Ls of the metal roof seam 600, such that a portion of the metal roof seam 600 is encompassed within the seam-receiving groove 300 in both the first and second directions. In that manner, the width, Ws, of the metal roof seam 600 is interposed in the second direction between the second sides 702 and 712 of the first and second lever members 700 and 710 respectively, and the height, Hs, (see FIG. 1) of the metal roof seam 600 substantially extends from the bottom surface 205 of the mounting block 200 toward the upper internal surface 303 of seam-receiving groove 300 in the first direction.

The first and second lever members 700 and 710 have lengths $L_1$ and $L_2$ respectively, extending in the longitudinal direction between the first ends 701 and 711 and the second ends 702 and 712 thereof. The first and second lever members 700 and 710 also have widths $W_1$ and $W_2$, respectively, extending in the second direction from the first sides 703 and 713 to the second sides 704 and 714 thereof. The lengths $L_1$ and $L_2$ of each lever member 700 and 710 are greater than three times the dimension of the respective widths $W_1$ and $W_2$, such that the lever members 700 and 710 will properly perform to produce the desired mechanical advantage described below.

The second side 704 of the first lever member 700 includes a protrusion 707 and recess 708, and the second side 714 of the second lever member 710 includes a recess 717 and a protrusion 718, such that the recesses 708 and 717 and the protrusions 707 and 718 correspond in axial opposition across a distance in the second direction, and such that the metal roof seam 600 housed within seam-receiving groove 300 is interposed therebetween. The protrusions 707 and 718, and recesses 708 and 717 can be formed in a variety of ways. For example, the structures can be incorporated into the mold design such that a cast lever includes one or both in the post-casting state. Another formation method involves machining a pre-formed lever such that the width thereof is reduced to provide the desired recess, protrusion, or both. This formation concept is generally applicable to the lever members included in other embodiments of the present invention as well.

Figure 2B:
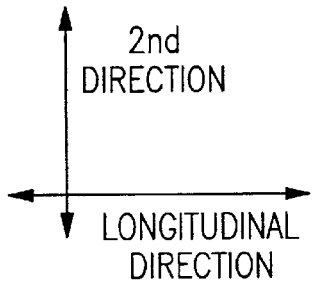
FIG. 2B is a cross-sectional view of the mounting assembly of another embodiment of the present invention.
Figure 2B:
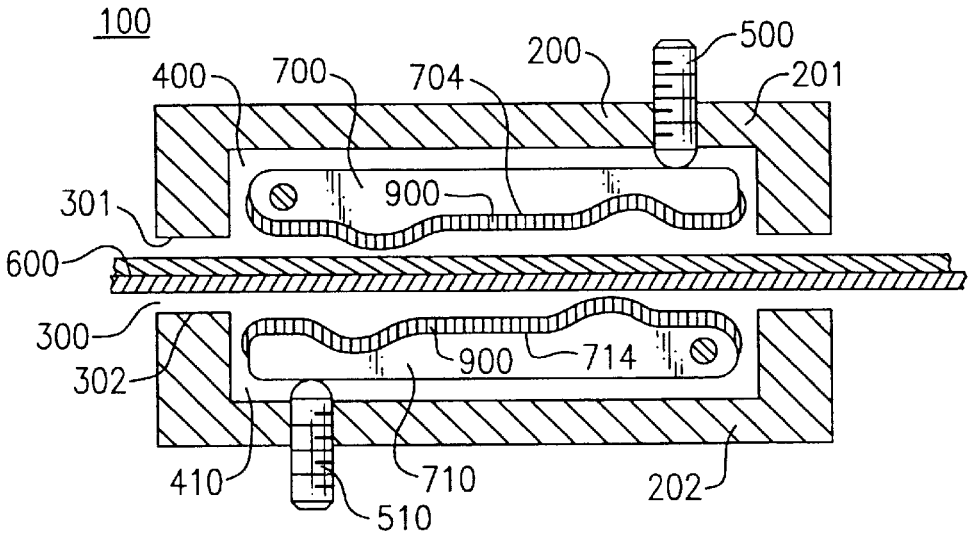

FIG. 2B is a cross-sectional view of another embodiment of the present invention, including a corrosion-resistant, non-metallic coating 900 on each of the second sides 704 and 714 of the lever members 700 and 710. The corrosion-resistant, non-metallic coating 900 provides a barrier against galvanic reactions between the metal roof seam, which is typically copper, and the metal mounting assembly, which is preferably aluminum. That is, when the first and second coupling elements 500 and 510 are activated to force the first and second lever members 700 and 710 out of the first and second channels 400 and 410, respectively, the metal roof seam within the seam-receiving groove 300 is gripped by the coated second sides 704 and 714 of the lever members 700 and 710. In that way, the value of the increased pressure distribution and structural protection facilitated by the lever-action gripping mechanism is not inhibited by galvanic reactions usually known to occur at the coupling point between a metal roof seam and prior art mounting assemblies.

Figure 3:
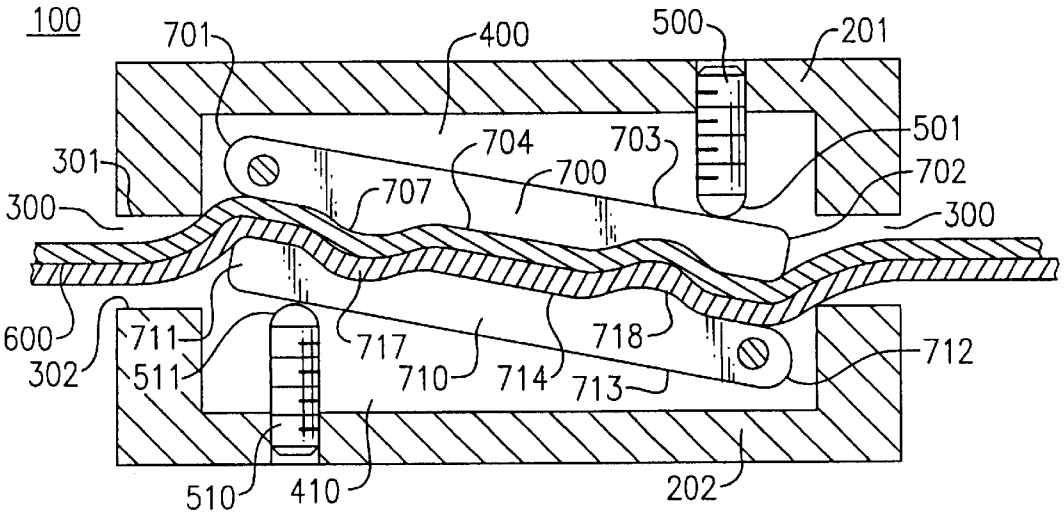
FIG. 3 is a cross-sectional view of the mounting assembly taken through line 2—2 in FIG. 1, shown after the coupling elements engage the lever members to grip the metal roof seam.

FIG. 3 is a cross-sectional view of the mounting assembly 100 taken in the second direction through line 2—2 in FIG.1, shown after coupling elements 500 and 510 engage lever members 700 and 710 to grip the metal roof seamy 600. When the coupling elements 500 and 510 are actuated, the terminal ends 501 and 511 thereof contact the first sides 703 and 713 of the first and second lever members 700 and 710, respectively, within the respective first and second channels 400 and 410. The second end 702 of the first lever member 700, the first end 711 of the second lever member 710, and portions of the respective lengths $L_1$ and $L_2$ of the first and second lever members 700 and 710, translocate from their original positions within the respective first and second channels 400 and 410 to positions within seam-receiving groove 300. The portion of the metal seam 600 sandwiched between the second sides 704 and 714 of lever members 700 and 710 within seam-receiving groove 300 is deformed into two S-shaped gripping areas substantially between the opposing protrusions and recesses. In this manner, the mounting assembly 100 is joined to the metal roof seam 600 by the lever members 700 and 710 such that relative longitudinal motion between the mounting assembly and the metal roof seam is prevented. The effective deformation along the length $L_s$, of the metal roof seam 600 within the seam-receiving groove 300, together with the S-shaped gripping areas, prevents unwanted axial movement of the mounting block 200 as seated on the metal seam 600.

The lever feature of the present invention, as described for the previous embodiments as well as those that follow, offers many benefits over prior art snow guard mounting assembly attachment means. Primarily, the mechanical advantage provided by the lever member increases the amount of deformation force that can be applied on the metal roof seam without directly subjecting the seam to harmful contact with the coupling element. That is, when the coupling element contacts the lever member near the end farthest from the fulcrum-like pivot member, force is transferred from the coupling element to the lever member along the length of the lever member, rather than at a concentrated contact point. In that manner, the metal roof seam experiences a greater amount of force distributed over a greater area than the force that would be experienced with using lever-less attachment means.

The mechanical advantage is increased when the protrusions on the second side of the lever are positioned proximate the pivot member. Since the threshold amount of mechanical pressure needed to deform the metal seam remains relatively constant, using the mechanical advantage afforded by a lever member reduces the actual amount of force that must be applied by a coupling element to overcome that threshold. Further, if the force applied by the coupling elements is increased, the resultant force will be further magnified over the distance of the lever and increase the effective deformation of the metal seam.

In addition to providing greater gripping efficiency without increasing the force actually applied by the coupling elements, the lever elements, particularly the protruding portions thereof, press onto, rather than rotate into, the surface of the metal seam to effectuate the desired gripping deformation. This pressing action is less harmful to the surface integrity of the seam, and the amount of force actually applied by a lever member in this manner is much greater than that which would ordinarily be tolerated from a coupling element in direct contact with the seam before causing harm to the surface thereof.

Figure 4A:
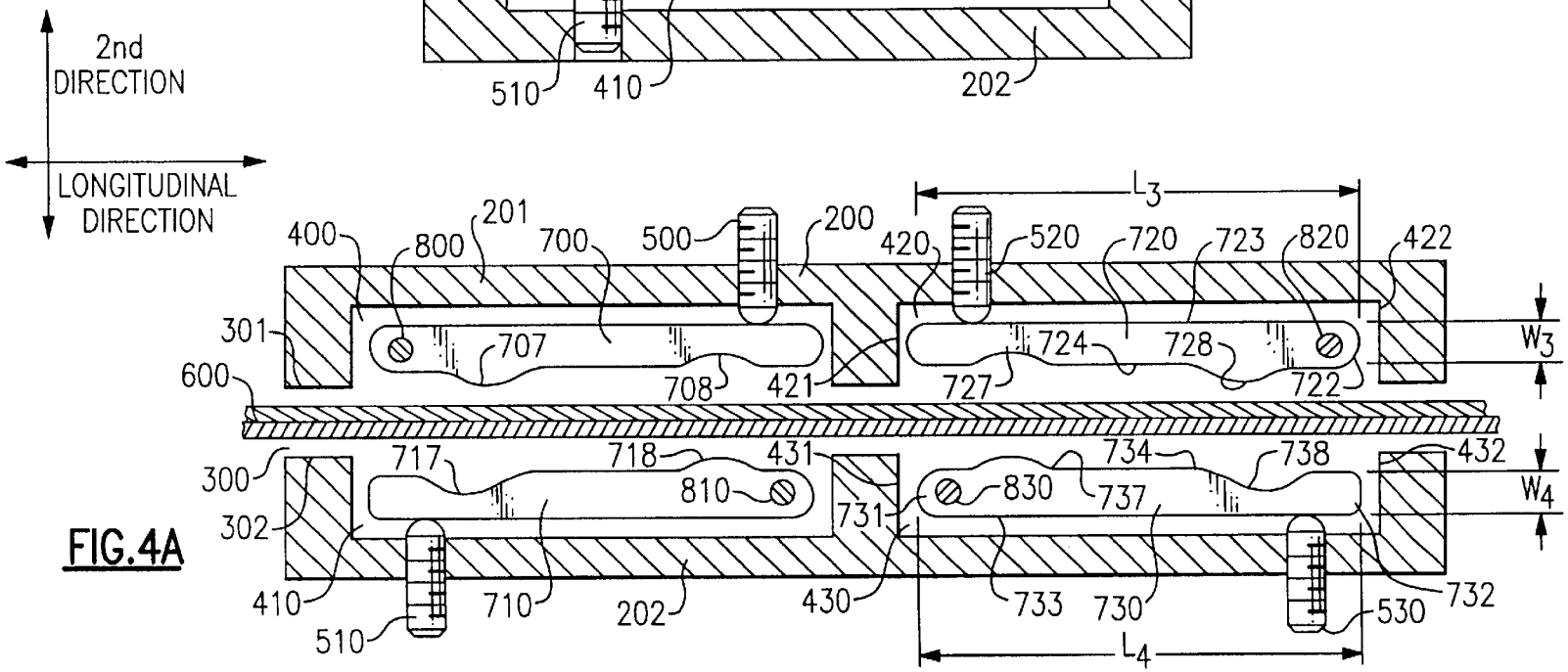
FIG. 4A is a cross-sectional view of another embodiment of the mounting assembly of the present invention.

FIG. 4A shows a cross-sectional view of the mounting assembly of another embodiment of the present invention positioned about a metal roof seam before the coupling elements engage the lever members to grip the metal roof seam. The embodiment shown herein incorporates some elements of the embodiment shown in FIG. 3 as described above, and further includes a third channel portion 420 formed in the first internal side 301 of seam-receiving groove 300 and spaced from the first channel 400 in the longitudinal direction, and a fourth channel portion 430 formed in the second internal side 302 of seam-receiving groove 300 and spaced from the second channel 410 in the longitudinal direction. As shown, the third channel 420 substantially axially opposes the fourth channel 430 over a distance in the second direction across the central axis of the seam-receiving groove. Because there are four channels rather than two, each channel extends a length in the longitudinal direction of the seam-receiving groove that is not substantially equal to the length of the seam-receiving groove itself. Although the channels are shown having approximately equal dimensions, it should also be noted that the sizes of the channels can vary with respect to each other without departing from the spirit of the present invention. Additionally, the length of the channels is mainly critical in that each channel must be long enough to house a lever member having a sufficient length to provide the aforementioned mechanical advantage.

A third lever member 720 is disposed within the third channel 420, having a first end 721 and an opposed second end 722 defining a length, $L_3$, extending therebetween in the longitudinal direction. The third lever member 720 also includes a first side 723 and an opposed second side 724 defining a width, $W_3$, extending therebetween in a second direction substantially perpendicular to the first direction and the longitudinal direction, and the second side 724 is adapted to contact a metal roof seam. The second side 724 of the third lever member 720 is provided with a recess 727 proximate the first end 721 thereof, and a protrusion 728 proximate the second end 722 thereof.

A fourth lever member 730 is likewise disposed within the fourth channel 430, having a first end 731 and an opposed second end 732 defining a length, $L_4$, extending therebetween in the longitudinal direction. The fourth lever member 730 further includes a first side 733 and an opposed second side 734 defining a width, $W_4$, extending therebetween in a second direction substantially perpendicular to the first direction and the longitudinal direction, and the second side 734 is adapted to contact a metal roof seam. The second side 734 of the fourth lever member 730 is provided with a protrusion 737 proximate the first end 731 thereof, and a recess 738 proximate the second end 732 thereof.

A third pivot member 820 passes through the bottom surface 205 of mounting block 200 in the first direction proximate the first side 201 thereof, and spaced a distance from the first pivot member 800 in the longitudinal direction of the mounting block 200. The third pivot member 820 penetrates the third channel 420 to contact and pivotally secure the third lever member 720 proximate the second end 722 thereof, and proximate the second end 422 of the third channel 420. In that manner, the first end 721 of the third lever member 720, and a portion of the length $L_3$ thereof, are freely translocatable from a position within the third channel 420 to a position within the seam-receiving groove 300 along the second direction toward the central axis thereof. A fourth pivot member 830 passes through the bottom surface 205 of mounting block 200 in the first direction proximate the second side 202 thereof, and spaced a distance from the second pivot member 810 in the longitudinal direction of the mounting block 200. The fourth pivot member 830 penetrates the fourth channel 430 to contact and pivotally secure the fourth lever member 730 proximate the first end 731 thereof, and proximate the first end 431 of the fourth channel 430. In that manner, the second end 732 of the fourth lever member 730, and a portion of the length $L_4$ thereof, are freely translocatable from a position within the fourth channel 430 to a position within seam-receiving groove 300 along the second direction toward the central axis thereof.

FIG. 4A further shows a third coupling element 520 having a terminal end 521 extending in the second direction through a first side 201 of the mounting block 200 and adapted to move inwardly toward the central axis of seam-receiving groove 300 to penetrate a portion of the third channel 420 channel and engage a portion of the third lever member 720 proximate the first end 721 thereof. A fourth coupling element 530 is also included, having a terminal end 531 extending in the second direction through the second side 202 of the mounting block 200 and adapted to move inwardly toward the central axis of seam-receiving groove 300 to penetrate a portion of the fourth channel 430 and engage a portion of the fourth lever member 730 proximate the second end 732 thereof.

The two opposing pairs of lever members contact and deform the metal roof seam over four substantially S-shaped gripping areas, and thusly hold the mounting assembly firmly thereto with an amount of force that could not heretofore be realized using a standard screw coupling member without damaging the metal seam surface. That is, the metal roof seam is deformed in a double-S-shapes by the first and second lever members 700 and 710, particularly at the protrusions 707 and 718 and the recesses 708 and 717, where the metal roof seam is deformed by pressing force from the protrusions into the recesses. A similar double S-shape deformation occurs with the third and fourth lever members 720 and 730, particularly at the protrusions 737 and 728 and the recesses 727 and 738, where the metal roof seam is deformed by pressing force from the protrusions into the recesses. The positions of the pressing protrusions promotes the mechanical advantage of the lever members, and the resultant force applied on the metal roof seam is effectively increased without being limited to the point of contact between the protrusion and the metal roof seam. Further, the metal roof seam is effectively distorted in the longitudinal direction along a portion of the length, $L_s$, interposed between the S-shaped gripping areas, further preventing unwanted axial movement within the seam-receiving groove.

Figures 4B, 4C:
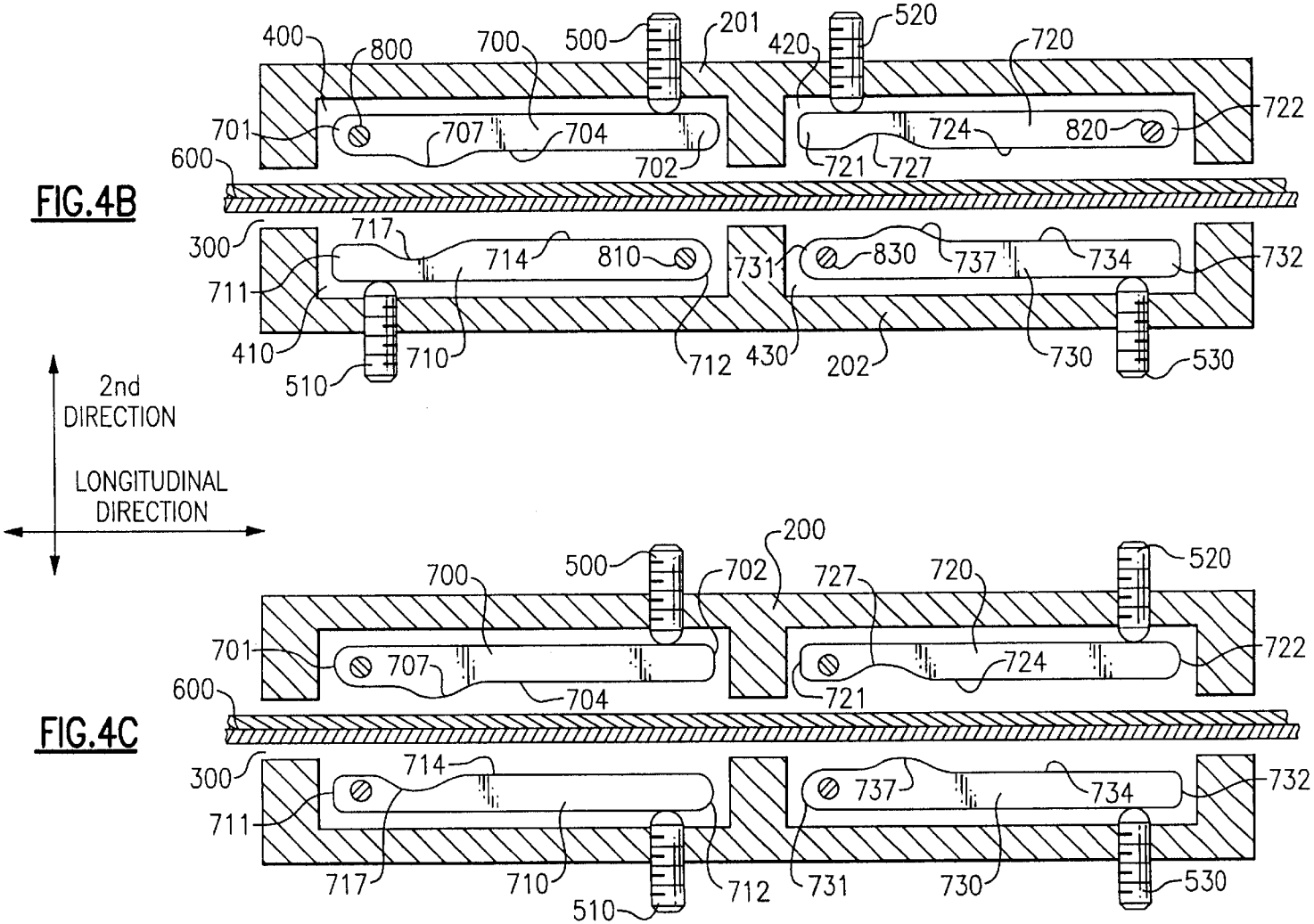
FIG. 4B is a cross-sectional view of another embodiment of the mounting assembly of the present invention.
FIG. 4C is a cross-sectional view of another embodiment of the mounting assembly of the present invention.

FIG. 4B is a cross-sectional view of another embodiment of the present invention. The main difference between this embodiment and the embodiment of FIG. 4A is that the lever members are each provided with one of a recess or a protrusion, rather than one of a recess and a protrusion. The first and third channels 400 and 420, formed in the first internal side 301 of the seam-receiving groove 300, oppose the second and fourth channels 410 and 430 formed in the second internal side 302 of the seam-receiving groove 300 across the central axis of the seam-receiving groove 300 and in the second direction. Lever members 700, 710, 720 and 730 are disposed within channels 400, 410, 420 and 430, respectively. Pivot members 800 and 830 are positioned proximate the first ends 701 and 731 of the first and fourth lever members 700 and 730, and pivot members 810 and 820 are positioned proximate the second ends 712 and 722 of the second and third lever members 710 and 720. Coupling elements 510 and 520 are positioned proximate the first ends 711 and 721 of the second and third lever members 710 and 720, while the coupling elements 500 and 530 are positioned proximate the second ends 702 and 712 of the first and fourth lever members 700 and 730. The second side 704 of the first lever member 700 includes a protrusion 707 proximate the first end 701 thereof, and the second side 714 of the second lever member includes a corresponding recess 717 proximate the first end 711 thereof. The second side 724 of the third lever member 720 includes a corresponding recess 727 proximate the first end 721 thereof, and the second side 734 of the fourth lever member 730 includes a protrusion 737 proximate the first end 731 thereof.

FIG. 4C represents another modified embodiment of the present invention, wherein each of the first ends 701–731 of the four lever members 700–730 are secured by pivot members 800–830, and each of the second ends 702 -732 and a portion of the lengths $L_1$–$L_4$ of the four lever members are freely translocatable from positions within the respective channels 400–430 to positions within the seam-receiving groove 300. The lever action achieved in this embodiment is not identical to that of the embodiment in FIG. 4B, however, since the opposing lever pairs are pivotally secured at ends which axially oppose each other across the central axis of the seam-receiving groove, rather than being pivotally secured at opposite and offset ends of the opposing levers.

Figure 5A:
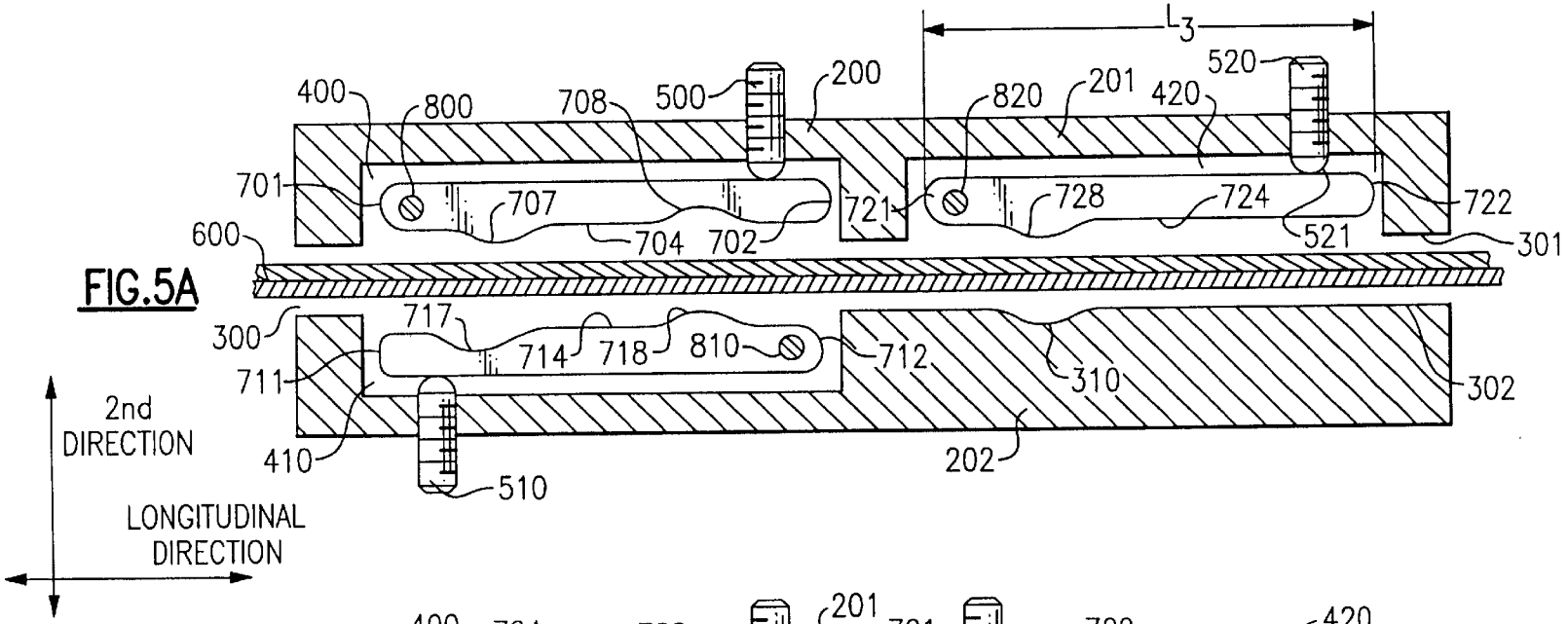
FIG. 5A is a cross-sectional view of another embodiment of the mounting assembly of the present invention.

FIG. 5A is a cross-sectional view of another embodiment of the mounting assembly 100 of the present invention, incorporating some elements of embodiment shown in FIG. 1, and further including a third channel portion 420 formed in the first internal side 301 of the seam-receiving groove 300 extending in the longitudinal direction from a first end 421 thereof to an opposed second end 422 thereof, and longitudinally spaced apart from the first channel 400. A third lever member 720 disposed within the third channel 420 includes a first end 721 and an opposed second end 722 defining a length, $L_3$, extending therebetween in the longitudinal direction. The third lever member 720 also includes a first side 723 and an opposed second side 724 defining a width, $W_3$, extending therebetween in a second direction substantially perpendicular to the first direction and the longitudinal direction, and the second side is adapted to contact a metal roof seam. Preferably, $L_3$ is greater than or equal to $3W_3$. FIG. 5A also shows a third pivot member 820 pivotally securing the first end 721 of the third lever member 720 such that second end 722 thereof and a portion of the length $L_3$ thereof are freely translocatable from a position within the third channel 420 to a position within the seam-receiving groove 300 along the second direction toward the central axis thereof.

FIG. 5A further shows a third coupling element 520 having a terminal end 521 extending through the first side 201 of the mounting block and adapted to move inwardly toward the central axis of the seam-receiving groove and penetrate the third channel portion 420 and engage a portion of the third lever member 720 proximate second end 722 thereof. It should be noted that the third coupling element 520 is preferably positioned proximate the end of the third lever member 720 opposing the pivotally secured end thereof for the alternate version described in the preceding paragraph, as well as for similar alternate embodiments.

The second side 704 of the first lever member is provided with a protrusion 707 proximate the first end 701 thereof, and a recess 708 proximate the second end 702 thereof. The second side 714 of the second lever member 710 includes a corresponding recess 717 proximate the first end 711 thereof, and a corresponding protrusion 718 proximate the second end 712 thereof. The second side 724 of the third lever member 720 includes a protrusion 728 proximate the first end 721 thereof, and the second internal side 302 of the seam-receiving groove 300 includes a corresponding 310 substantially axially opposed form the protrusion 728 across the central axis of the seam-receiving groove. The above embodiment further includes a first coupling element 500 proximate the second end 702 of the first lever member 700, a second coupling element 510 proximate the first end 711 of the second lever member 710, and a third coupling element 520 proximate the second end 722 of the third lever member 720. When the three coupling-elements are activated, the levers translocate from their initial positions within the respective channels to positions within the seam-receiving groove, and the metal roof seam interposed between the levers is deformed over three S-shaped areas, particularly defined by the respective protrusions and recesses on the second sides of the levers and the second internal side of the seam-receiving groove.

Although it is not shown in this example, it should be noted that the third pivot member 823 could be alternately and effectively positioned proximate the second end 722 of the third lever member 720 such that the first end 721 thereof is freely translocatable from a position within the third channel portion 420 to a position within the seam-receiving groove .300. It should be noted that the first lever member 700 could be alternately secured at the second end 702 thereof by pivot member 800, and similarly, the second lever member 710 could be alternately secured at the first end 711 thereof by pivot member 810. Although one of the above described embodiments is preferred, each of the first and second lever members 700 and 710 could also be pivotally secured at the respective first ends 701 and 711 thereof, and the third lever member 720 could be secured proximate the second end 722 thereof by the third pivot member 820.

Figure 5B:
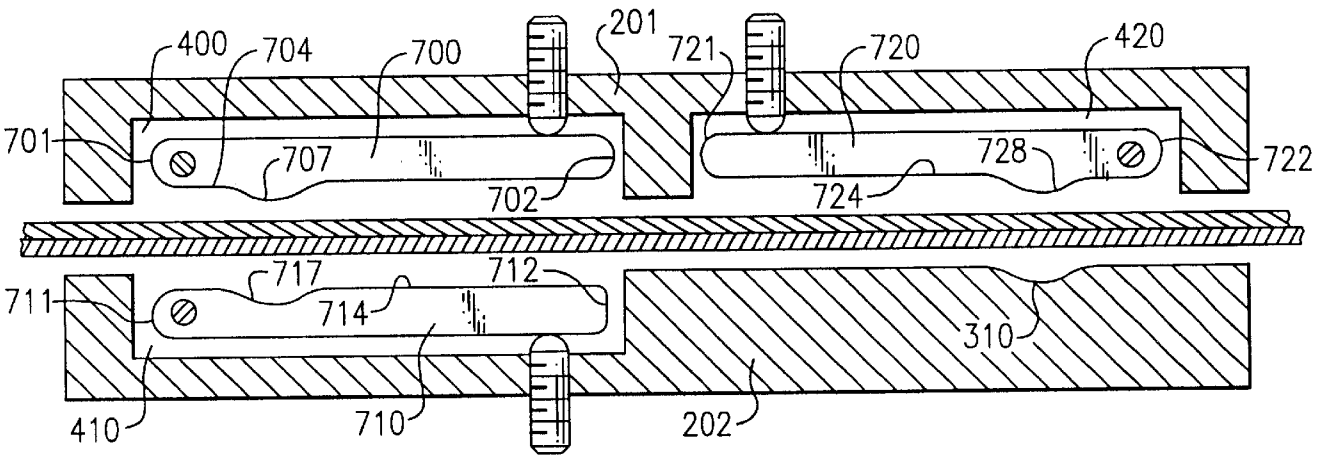
FIG. 5B is a cross-sectional view of another embodiment of the mounting assembly of the present invention.

FIG. 5B is a cross-sectional view of another embodiment of the present invention, similar to the embodiment shown in FIG. 5A, but differing in that the second lever member 710 is pivotally secured proximate the first end 711 thereof such that the second end 712 thereof, and a portion of the length $L_2$ thereof, are freely translocatable from a position within the second channel 410 to a position within the seam-receiving groove 300. The third lever member 720 is pivotally secured proximate the second end 722 thereof, such that the first end 721 thereof, and a portion of the length $L_3$ thereof, are freely translocatable from a position within the third channel 420 to a position within the seam-receiving groove 300. The second coupling element 510 is positioned proximate the second end 712 of the second lever member 710, and the third coupling element 520 is positioned proximate the first end 721 of the third lever member 720. Another important difference is that the second side 704 of the first lever member 700 includes a protrusion 707 proximate the first end 701 thereof, and the second side 714 of the second lever member 710 includes a corresponding recess 717 proximate the first end 711 thereof. A metal seam will be deformed by this configuration over two S-shaped regions, particularly defined by the protrusion 707 and the recess 717, and the protrusion 728 and the corresponding recess 310 on the second internal side 302 of the seam-receiving groove 300.

Figure 6A:
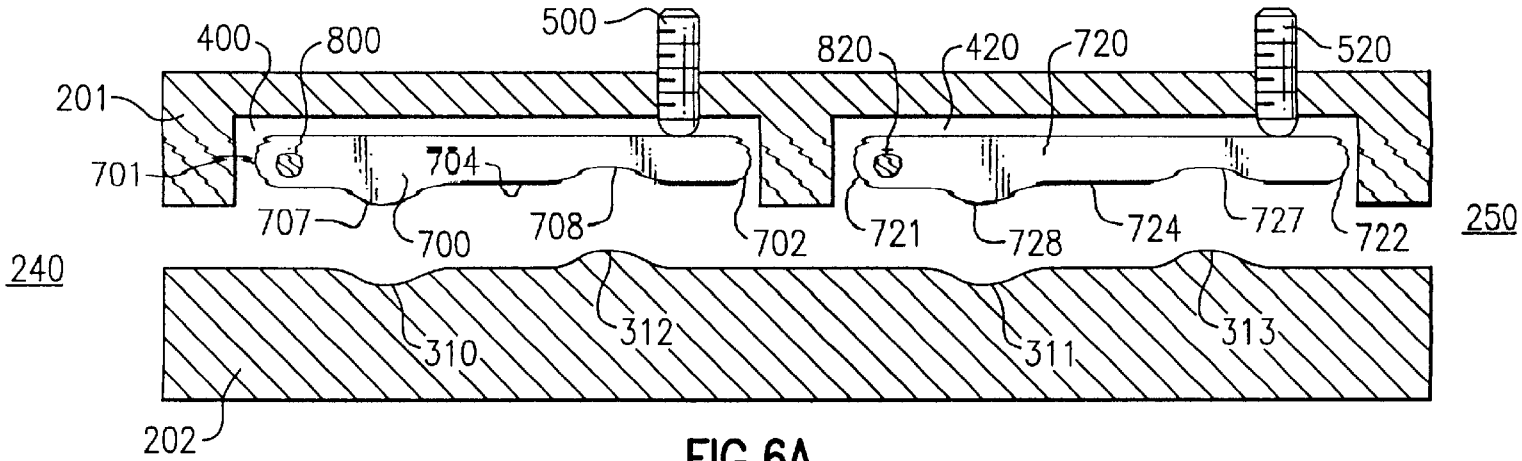
FIG. 6A is a cross-sectional view of the mounting assembly of another embodiment of the present invention.

FIG. 6A is a cross-sectional view of yet another embodiment of the present invention. A first lever member 700 is disposed within a first channel 400 proximate the first side 201 of the mounting block 200, and proximate the first end 240 thereof. A second lever member 720 is disposed within a second channel 420 proximate the first side 201 of the mounting block 200, and proximate the rear end 250 thereof. The second sides 704 and 724 of the levers 700 and 720 include protrusions 707 and 728, and the axially opposed second internal side 302 of the seam-receiving groove 300 respectively includes opposing and corresponding protrusions 312 and 313 and recesses 310 and 311.

The protrusions and recesses in the second internal side of the seam-receiving groove can be easily machined to provide the desired structure at the desired position within the seam-receiving groove. The machining can be performed contemporaneously with the formation of the seam-receiving groove, or in a post-formation manner. It is also possible to cast the mounting block including the seam-receiving groove having a variety of internal structures, such as channels, protrusions and recesses, however this calls for a complex mold, which partially accounts for the preferential nature of post-cast machining to form the desired structures.

The first lever 700 is pivotally secured by a pivot member 800 proximate the first end 701 thereof, and a coupling element 500 is positioned proximate the second end 702 thereof. The second lever 720 is pivotally secured by a pivot member 820 proximate the first end 721 thereof, and a coupling element 520 is positioned proximate the second end 722 thereof. An elongated double-S grip on the metal roof seam interposed between the levers and the second side of the seam-receiving groove is achieved when the coupling elements are activated, which effectively holds the mounting assembly in a desired stationary position relative to the metal roof seam.

Figure 6B:
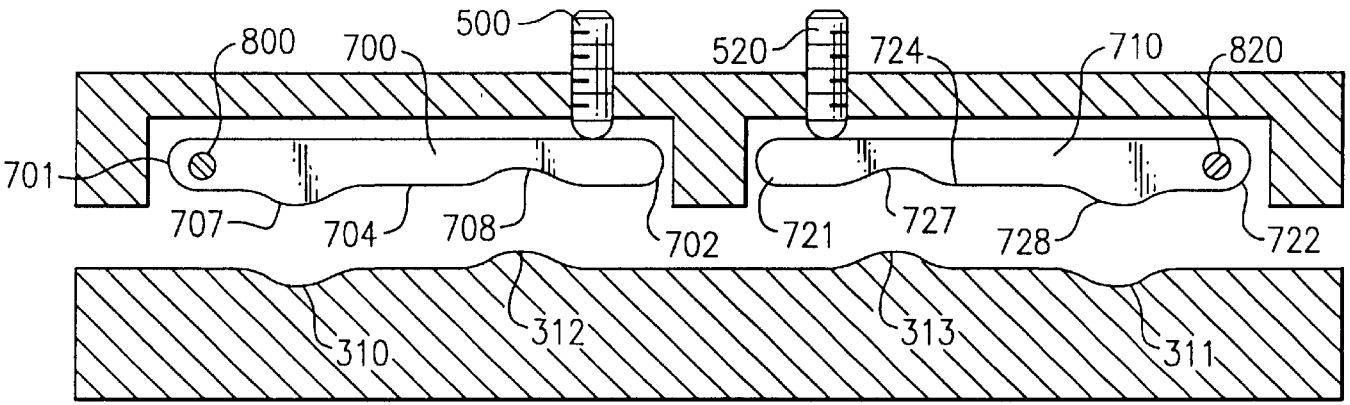
FIG. 6B is a cross-sectional view of the mounting assembly of another embodiment of the present invention.

FIG. 6B is another embodiment of the present invention, differing from the embodiment shown in FIG. 6A in that the second lever member 720 is pivotally secured proximate the second end 722 thereof. The protrusion 728 is positioned proximate the second end 722 of the second lever member 720, and the recess 727 is positioned proximate the first end 721 thereof. Accordingly, the recess 311 and the protrusion 313 are correspondingly positioned with respect to the second lever member 720 in axial opposition across the central axis of the seam-receiving groove 300. The second coupling element 520 is proximate the first end 721 of the second lever member 720, such that, upon activation, the second coupling element forces the first end 721 of the second lever member 720 from a position in the second channel 420 to a position within the seam-receiving groove 300.

The configuration shown in FIG. 6B facilitates a double S-shaped grip on the metal roof seam which is different than that shown in FIG. 6A due to the relative displacement of the recess 311 and the protrusion 313 on the second internal side 302 of the seam-receiving groove 300. The effect, however, is similar in that unwanted longitudinal and axial movement between the mounting assembly and the metal seam is thusly prevented without damaging the surface integrity of the deformed metal roof seam.

Figure 7A:
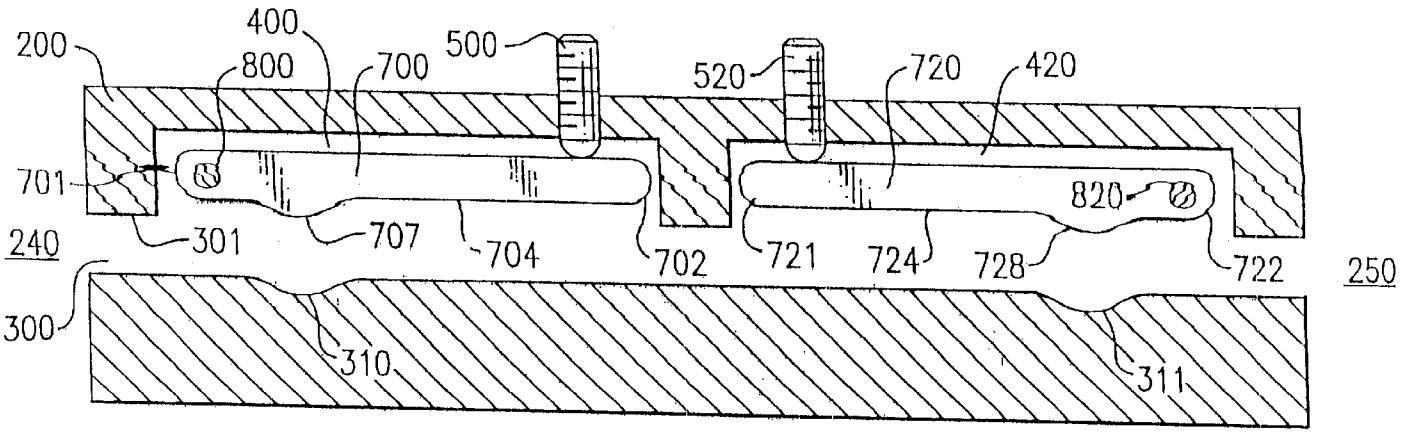
FIG. 7A is a cross-sectional view of another embodiment of the mounting assembly of the present invention.

FIG. 7A is a cross-sectional view of another embodiment of the present invention. As shown, the first lever member 700 positioned within a first channel 400 formed in the first internal side 301 of the seam-receiving groove 300 is pivotally secured by a pivot member 800 proximate the first end 701 of the first lever member 700, such that the second end 702 thereof is freely translocatable from a position within the first channel portion 400 to a position within the seam-receiving groove 300. The second lever member 720 positioned within a second channel 420 formed in the first internal side 301 of the seam-receiving groove 300 is pivotally secured by a pivot member 820 proximate the second end 722 of the second lever member 720, such that the first end 721 thereof is freely translocatable from a position within the second channel 420 to a position within the seam-receiving groove 300.

The second internal side 302 of seam-receiving groove 300 is provided with a first recess 310 proximate the front end 240 of mounting block 200 and spaced a distance therefrom over a distance in the longitudinal direction, and opposing a portion of the first channel 400. In that manner, the first recess 310 substantially is aligned with a portion of the first lever member 700 across a distance in the second direction. Preferably, the first recess 310 is aligned with an opposing protrusion 707 on the second side 704 of the first lever member 700 proximate the first end 701 thereof.

The second internal side 302 of seam-receiving groove 300 is further provided with a second recess 311 spaced from the first recess 310 over a distance in the longitudinal direction, such that the second recess 311 is interposed between the first recess 310 and the back end 250 of the mounting block 200. The second recess 311 opposes a portion of the second channel portion 420 such that the second recess 311 is substantially aligned with a portion of the second lever member 720 across a distance in the second direction. Preferably, the second recess 311 is aligned with an opposing protrusion 728 on the second side 724 of the second lever member 720 proximate the second end 722 thereof.

Figure 7B:
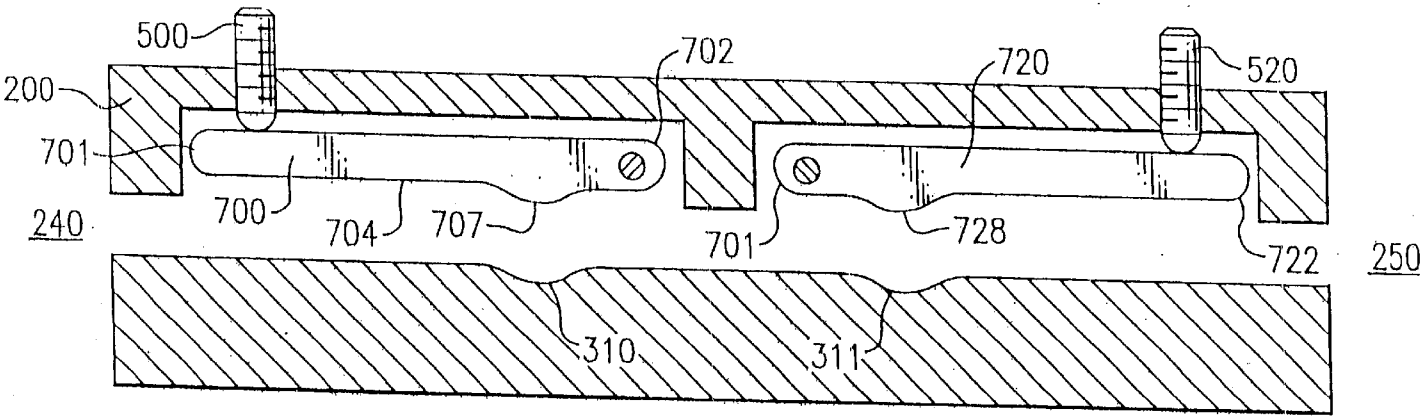
FIG. 7B is a cross-sectional view of another embodiment of the mounting assembly of the present invention.

It should be noted that either of the first and second ends of either lever member can be pivotally secured, and the protrusions on the second sides of the levers should optimally be positioned proximate the pivotally secured ends thereof to best utilize the mechanical advantage afforded by the lever configuration. Accordingly, the recesses 310 and 311 on the second internal side of the seam-receiving groove should be positioned to correspond with the opposing protrusions. An example of an embodiment of the present invention thusly modified is shown in FIG. 7B.

While the present invention has been particularly shown and described with reference to the preferred mode as illustrated in the drawings, it will be understood by one skilled in the art that various changes may be effected therein without departing from the spirit and the scope of the invention as defined by the claims.

I claim:

1. A snow guard assembly adapted to be attached to a metal roof seam by a mounting assembly, said mounting assembly comprising:

a mounting block having a seam-receiving groove formed in a bottom surface thereof, said seam-receiving groove being partially defined by a first internal side, an opposed second internal side, and an upper internal side interposed therebetween, said upper internal side being spaced apart from said bottom surface of said mounting block in a first direction, said seam-receiving groove extending longitudinally from a front end of said mounting block to a back end thereof in a longitudinal direction of said mounting block substantially perpendicular to said first direction;

a first channel formed in said first internal side of said seam-receiving groove and extending in said longitudinal direction from a first end thereof to an opposed second end thereof;

a lever member disposed within said channel and having a first end and an opposed second end defining a length, L, extending therebetween in said longitudinal direction, and a first side and an opposed second side defining a width, W, extending therebetween in a second direction substantially perpendicular to said first direction and said longitudinal direction wherein said second side is adapted to contact a metal roof seam and L is greater than or equal to 3 W, wherein said lever member comprises at least one of a protrusion on said second side thereof proximate one of said first and said second ends thereof, and a recess on said second side thereof proximate the other end of said lever member;

a pivot member for pivotally securing one of said first end and said second end of said lever member proximate one of said first end and said second end of said channel such that the other end of said lever member is freely translocatable from a position wit said channel to a position within said seam-receiving groove along said second direction toward a central axis of said seam-receiving groove; and a coupling element having a terminal end extending through a first side of said mounting block and adapted to move inwardly toward said central axis of said seam-receiving groove and penetrate said channel and engage a portion of said lever member proximate the other end thereof.

2. The snow guard assembly of claim 1, wherein said second internal side of said seam-receiving groove comprises a recess substantially axially aligned with said protrusion of said lever member across said central axis of said seam-receiving groove therefrom.

3. The snow guard assembly of claim 1, wherein said second internal side of said seam-receiving groove comprises a protrusion substantially axially aligned with said recess of said lever member across said central axis of said seam-receiving groove.

4. The snow guard assembly of claim 1, wherein at least said second side of said lever member is coated with a corrosion-resistant, non-metallic material.

5. The snow guard assembly of claim 4, wherein said corrosion-resistant, non-metallic material comprises at least one material selected from the group consisting of urethane, epoxy, plastic and aluminum oxide.

6. The snow guard assembly of claim 1, wherein said lever member is pivotally secured proximate said second end thereof such that said first end of said lever member is freely translocatable from a position within said channel to a position within said seam-receiving groove.

7. The snow guard assembly of claim 1, wherein said lever member is pivotally secured proximate said first end thereof such that said second end of said lever member is freely translocatable from a position within said channel to a position within said seam-receiving groove.

8. A snow guard assembly adapted to be attached to a metal roof seam by a mounting assembly, said mounting assembly comprising:

a mounting block having a seam-receiving groove formed in a bottom surface thereof, said seam-receiving groove being partially defined by a first internal side, an opposed second internal side, and an upper internal side interposed therebetween, said upper internal side being spaced apart from said bottom surface of said mounting block in a first direction, said seam-receiving groove extending longitudinally from a front end of said mounting block to a back end thereof in a longitudinal direction of said mounting block substantially perpendicular to said first direction;

a first channel formed in said first internal side of said seam-receiving groove and extending in said longitudinal direction from a first end thereof to an opposed second end thereof;

a second channel formed in said second internal side of said seam-receiving groove and extending in said longitudinal direction from a first end thereof to an opposed second end thereof;

a first lever member disposed within said first channel and having a first end and an opposed second end defining a length, $L_1$, extending therebetween in said longitudinal direction, and a first side and an opposed second side defining a width, $W_1$, extending therebetween in a second direction substantially perpendicular to said first direction and said longitudinal direction, wherein said second side is adapted to contact a metal roof seam;

a second lever member disposed within said second channel and having a first end and an opposed second end defining a length, $L_2$, extending therebetween in said longitudinal direction, and a first side and an opposed second side defining a width, $W_2$, extending therebetween in a second direction substantially perpendicular to said first direction and said longitudinal direction, wherein said second side is adapted to contact a metal roof seam;

a first pivot member for pivotally securing one of said first end and said second end of said first lever member proximate one of said first end and said second end of said first channel such that the other end of said first lever member is freely translocatable from a position within said first channel to a position within said seam-receiving groove along said second direction toward a central axis of said seam-receiving groove;

a second pivot member for pivotally securing one of said first and said second ends of said second lever member proximate one of said first and said second ends of said second channel such that the other end thereof is freely translocatable from a position within said second channel to a position within said seam-receiving groove along said second direction toward a central axis of said seam-receiving groove;

a first coupling element having a terminal end extending through a first side of said mounting block and adapted to move inwardly toward said central axis of said seam-receiving groove and penetrate said first channel and engage a portion of said first lever member proximate the other end thereof; and a second coupling element having a terminal end extending through a second side of said mounting block and adapted to move inwardly toward said central axis of said seam-receiving groove and penetrate said second channel and engage a portion of said second lever member proximate the other end thereof.

9. The snow guard assembly of claim 8, wherein said first lever member comprises at least one of a protrusion proximate one of said first end and said second end thereof and a recess substantially proximate the other end thereof.

10. The snow guard assembly of claim 9, wherein said second lever member comprises at least one of a respective complimentary protrusion and a respective complimentary recess.

11. The snow guard assembly of claim 8, wherein said first pivot member is positioned proximate said first end of said first lever member such that said second end thereof is freely translocatable from a position within said second channel to a position within said seam-receiving groove in said second direction toward said central axis thereof.

12. The snow guard assembly of claim 8, wherein said first pivot member is positioned proximate said second end of said second lever member such that said first end thereof is freely translocatable from a position within said second channel to a position within said seam-receiving groove in said second direction toward said central axis thereof.

13. The snow guard assembly of claim 8, wherein said second pivot member is positioned proximate said first end of said second lever member such that said second end thereof is freely translocatable from a position within said second channel to a position within said seam-receiving groove in said second direction toward said central axis thereof.

14. The snow guard assembly of claim 8, wherein said second pivot member is positioned proximate said second end of said second lever member such that said first end thereof is freely translocatable from a position within said second channel to a position within said seam-receiving groove in said second direction toward said central axis thereof.

15. The snow guard assembly of claim 8, wherein $L_1$ is greater than or equal to $3W_1$, and Lo is greater than or equal to 3 $W_2$.

16. The snow guard assembly of claim 8, wherein said first channel opposes said second channel in substantial alignment therewith in said second direction across said central axis of said seam-receiving groove.

17. The snow guard assembly of claim 8, wherein said first channel is axially offset from said second channel along said seam-receiving groove in said longitudinal direction.

18. The snow guard assembly of claim 8, further comprising a third channel formed in one of said first and second internal sides of said seam-receiving groove extending in said longitudinal direction from a first end thereof to an opposed second end thereof;

a third lever member disposed within said third channel and having a first end and an opposed second end defining a length, $L_3$, extending therebetween in said longitudinal direction, and a first side and an opposed second side defining a width, $W_3$, extending therebetween in a second direction substantially perpendicular to said first direction and said longitudinal direction, wherein said second side is adapted to contact a metal roof seam;

a third pivot member for pivotally securing one of said first and second ends of said third lever member proximate one of said fist and second ends thereof such that the other end thereof is freely translocatable from a position within said third channel to a position within said seam-receiving groove along said second direction toward a central axis of said seam-receiving groove, and a third coupling element having a terminal end extending through a corresponding side of said mounting block and adapted to move inwardly toward said central axis of said seam-receiving groove and penetrate said third channel and engage a portion of said third lever member proximate the other end thereof.

19. The snow guard assembly of claim 18, further comprising a fourth channel formed in the other one of said first and second internal sides of said seam-receiving groove extending in said longitudinal direction from a first end thereof to an opposed second end thereof;

a fourth lever member disposed within said fourth channel and having a first end and an opposed second end defining a length, $L_4$, extending therebetween in said longitudinal direction, and a first side and an opposed second side defining a width, $W_4$, extending therebetween in a second direction substantially perpendicular to said first direction and said longitudinal direction, wherein said second side is adapted to contact a metal roof seam;

a fourth pivot member for pivotally securing one of said first and second ends of said fourth lever member proximate one of said fist and second ends thereof such that the other end thereof is freely translocatable from a position within said fourth channel to a position within said seam-receiving groove along said second direction toward a central axis of said seam-receiving groove; and a fourth coupling element having a terminal end extending through a corresponding side of said mounting block and adapted to move inwardly toward said central axis of said seam-receiving groove and penetrate said fourth channel and engage a portion of said fourth lever member proximate the other end thereof.

20. The snow guard assembly of claim 19, wherein $L_3$ is greater than or equal to 3 $W_3$, and $L_4$ is greater 3 $W_4$.

21. The snow guard assembly of claim 19, wherein at least said second side of at least one of said third and said fourth lever members is coated with a corrosion resistant material.

22. The snow guard assembly of claim 21, wherein said corrosion-resistant, non-metallic material comprises at least one material selected from the group consisting of urethane, epoxy, plastic and aluminum oxide.

23. The snow guard assembly of claim 8, wherein at least said second side of at least one of said first and said second lever members is coated with a corrosion resistant material.

24. A snow guard system adapted to be attached to a metal roof seam by a mounting assembly, said mounting assembly comprising:

a mounting block having a seam-receiving groove formed in a bottom surface thereof, said seam-receiving groove being partially defined by a first internal side, an opposed second internal side, and an upper internal side interposed therebetween, said upper internal side being spaced apart from said bottom surface of said mounting block in a first direction, said seam-receiving groove extending longitudinally from a front end of said mounting block to a back end thereof in a longitudinal direction of said mounting block substantially perpendicular to said first direction;

a first channel formed in said first internal side of said seam-receiving groove and extending in said longitudinal direction tom a first end thereof to an opposed second end thereof;

another channel formed in said first internal side of said seam-receiving groove longitudinally spaced apart from said first channel and extending in said longitudinal direction from a first end thereof to an opposed second end thereof;

a lever member disposed within said channel and having a first end and an opposed second end defining a length, L, extending therebetween in said longitudinal direction, and a first side and an opposed second side defining a width, W, extending therebetween in a second direction substantially perpendicular to said first direction and said longitudinal direction, wherein said second side is adapted to contact a metal roof seam and L is greater than or equal to 3 W;

another lever member disposed within said another channel and having a first end and an opposed second end defining a length, $L_A$, extending therebetween in said longitudinal direction, and a first side and an opposed second side defining a width, $W_A$, extending therebetween in a second direction substantially perpendicular to said first direction and said longitudinal direction, wherein said second side is adapted to contact a metal roof seam and $L_A$ is greater than or equal to 3 $W_A$;

a pivot member for pivotally securing one of said first end and said second end of said lever member proximate one of said first end and said second end of said channel such that the other end of said lever member is freely translocatable from a position within said channel to a position within said seam-receiving groove along said second direction toward a central axis of said seam-receiving groove;

another pivot member for pivotally securing one of said first end and said second end of said another lever member such that other end hereof is freely translocatable from a position within said another channel to a position within said seam-receiving groove along said second direction toward a central axis of said seam-receiving groove;

a coupling element having a terminal end extending through a first side of said mounting block and adapted to move inwardly toward said central axis of said seam-receiving groove and penetrate said channel and engage a portion of said lever member proximate the. other end thereof; and another coupling element having a animal end extending through a first side of said mounting block and adapted to move inwardly toward said central axis of said seam-receiving groove and penetrate said another channel and engage a portion of said another lever member proximate the other end thereof.

25. The snow guard assembly of claim 24, further comprising a first recess formed in said second internal side of said seam-receiving groove substantially opposing the pivotally secured end of said lever member in substantial alignment in said second direction across said central axis of said seam-receiving groove, and a second recess formed in said second internal side of said seam-receiving groove spaced a distance from said first recess in said longitudinal direction and substantially opposing the pivotally secured end of said another lever member in substantial alignment in said second direction across said central axis of said seam-receiving groove.

26. The snow guard assembly of claim 24, wherein said another member is pivotally secured proximate said second end thereof such that said first end of said another lever member is freely translocatable from a position within said another channel to a position within said seam-receiving groove.

27. The snow guard assembly of claim 24, wherein said another lever member is pivotally secured proximate said second end thereof such that said first end of said another lever member is freely translocatable from a position within said another channel to a position within said seam-receiving groove.

* * * * *